US009633645B2

(12) United States Patent
Wurm et al.

(10) Patent No.: US 9,633,645 B2
(45) Date of Patent: Apr. 25, 2017

(54) ADAPTIVE NOISE CONTROL SYSTEM WITH IMPROVED ROBUSTNESS

(71) Applicant: Harman Becker Automotive Systems GmbH, Karlsbad (DE)

(72) Inventors: Michael Wurm, Straubing (DE); Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 14/839,253

(22) Filed: Aug. 28, 2015

(65) Prior Publication Data

US 2016/0071508 A1 Mar. 10, 2016

(30) Foreign Application Priority Data

Sep. 10, 2014 (EP) ..... 14184290

(51) Int. Cl.
*G10K 11/178* (2006.01)

(52) U.S. Cl.
CPC ..... *G10K 11/1784* (2013.01); *G10K 11/1782* (2013.01); *G10K 11/1786* (2013.01); *G10K 2210/128* (2013.01); *G10K 2210/1282* (2013.01); *G10K 2210/3026* (2013.01); *G10K 2210/3027* (2013.01); *G10K 2210/3046* (2013.01); *G10K 2210/3048* (2013.01); *G10K 2210/3055* (2013.01);

(Continued)

(58) Field of Classification Search
None
See application file for complete search history.

(56) References Cited

U.S. PATENT DOCUMENTS 5,499,302 A * 3/1996 Nagami ..... G10K 11/1784 381/71.11
8,270,626 B2 * 9/2012 Shridhar ..... G10K 11/1782 341/110

(Continued)

FOREIGN PATENT DOCUMENTS

WO 2014045892 A2 3/2014

OTHER PUBLICATIONS

Extended European Search Report for corresponding Application No. 14184290.6, mailed Mar. 13, 2015, 7 pages.

*Primary Examiner* — Paul Huber
(74) *Attorney, Agent, or Firm* — Brooks Kushman P.C.

(57) ABSTRACT

A method for determining an estimation of a secondary path transfer characteristic in an ANC system is described herein. In accordance with one example of the invention, the method includes the positioning of a microphone array in a listening room symmetrically with respect to a desired listening position and reproducing at least one test signal using a loudspeaker arranged within the listening room to generate an acoustic signal. The acoustic signal is measured with the microphones of the microphone array to obtain a microphone signal from each microphone of the microphone array, and a numerical representation of the secondary path transfer characteristic is calculated for each microphone signal based on the test signal and the respective microphone signal. The method further includes averaging the calculated numerical representations of the secondary path transfer characteristic to obtain the estimation of the secondary path transfer characteristic to be used in the ANC system.

20 Claims, 5 Drawing Sheets

(52) U.S. Cl.
CPC ..... *G10K 2210/3057* (2013.01); *G10K 2210/3214* (2013.01); *G10K 2210/504* (2013.01)

(56) References Cited

U.S. PATENT DOCUMENTS

| | | | | |
|---|---|---|---|---|
| 2005/0207585 | A1* | 9/2005 | Christoph ..... | G10K 11/1788 381/71.11 |
| 2010/0124337 | A1 | 5/2010 | Wertz et al. | |
| 2010/0195844 | A1 | 8/2010 | Christoph et al. | |

* cited by examiner

ADAPTIVE NOISE CONTROL SYSTEM WITH IMPROVED ROBUSTNESS

CROSS-REFERENCE TO RELATED APPLICATIONS

This application claims priority to EP Application No. 14184290.6, filed Sep. 10, 2014, the disclosure of which is incorporated in its entirety by reference herein.

TECHNICAL FIELD

The present invention relates to an active noise control (ANC) system, in particular to an ANC system that is more robust with regard to variations of the secondary path transfer characteristics.

BACKGROUND

Disturbing noise—in contrast to a useful sound signal—is sound that is not intended to meet a certain receiver, e.g., a listener's ears. The generation process of noise and disturbing sound signals can generally be divided into three subprocesses. These are the generation of noise by a noise source, the transmission of the noise away from the noise source and the radiation of the noise signal. Suppression of noise may take place directly at the noise source by means of damping, for example. Suppression may also be achieved by inhibiting or damping the transmission and/or radiation of noise. However, in many applications, these efforts do not yield the desired effect of reducing the noise level in a listening room below an acceptable limit. Deficiencies in noise reduction can be observed especially in the bass frequency range. Additionally or alternatively, noise control methods and systems may be employed that eliminate or at least reduce the noise radiated into a listening room by means of destructive interference, i.e., by superposing the noise signal with a compensation signal. Such systems and methods are summarized under the term active noise canceling or active noise control (ANC).

Although it is known that "points of silence" can be achieved in a listening room by superposing a compensation sound signal and the noise signal to be suppressed such that they destructively interfere, a reasonable technical implementation was not feasible before the development of cost-effective, high-performance digital signal processors, which may be used together with an adequate number of suitable sensors and actuators.

Current systems for actively suppressing or reducing the noise level in a listening room (known as "active noise control" or "ANC" systems) generate a compensation sound signal with the same amplitude and frequency components for each noise signal to be suppressed, but with a phase shift of 180° with respect to the noise signal. The compensation sound signal interferes destructively with the noise signal; the noise is thus eliminated or damped at least at certain positions within the listening room. These positions in which a high damping of noise is achieved are often referred to as "sweet spots".

In the case of a motor vehicle, the term noise covers, among other things, noise generated by mechanical vibrations of the engine or fans and components mechanically coupled to them, noise generated by the wind when driving and noise generated by the tires. Modern motor vehicles may comprise features such as so-called "rear seat entertainment", which presents high-fidelity audio using a plurality of loudspeakers arranged within the passenger compartment of the motor vehicle. In order to improve the quality of sound reproduction, disturbing noise has to be considered in digital audio processing. Besides this, another goal of active noise control is to facilitate conversations between people sitting in the rear seats and the front seats.

Modern ANC systems depend on digital signal processing and digital filter techniques. A noise sensor (for example, a microphone or non-acoustic sensor) may be employed to obtain an electrical reference signal that represents the disturbing noise signal generated by a noise source. This reference signal is fed to an adaptive filter; the filtered reference signal is then supplied to an acoustic actuator (e.g., a loudspeaker) that generates a compensation sound field in phase opposition to the noise within a defined portion of the listening room (i.e., within the sweet spot), thus eliminating or at least damping the noise within this defined portion of the listening room. The residual noise signal may be measured by means of microphones in or close to each sweet spot. The resulting microphone output signals may be used as error signals, which are fed back to the adaptive filter, where the filter coefficients of the adaptive filter are modified such that a norm (e.g., the power) of the error signals is minimized.

A known digital signal processing method frequently used in adaptive filters is an enhancement of the known least mean squares (LMS) method for minimizing the error signal, or more precisely the power of the error signal. These enhanced LMS methods include, for example, the filtered-x LMS (FXLMS) algorithm (or modified versions thereof) and related methods such as the filtered-error LMS (FELMS) algorithm. A model that represents the acoustic transmission path from the acoustic actuator (i.e., loudspeaker) to the error signal sensor (i.e., microphone) is thereby used to apply the FXLMS (or any related) algorithm. This acoustic transmission path from the loudspeaker to the microphone is usually referred to as the "secondary path" of the ANC system, whereas the acoustic transmission path from the noise source to the microphone is usually referred to as the "primary path" of the ANC system.

In general, ANC systems have multiple inputs (at least one error microphone in each listening position, i.e., sweet spot) and multiple outputs (a plurality of loudspeakers); they are thus referred to as "multi-channel" or "MIMO" (multiple input/multiple output) systems. In the multi-channel case, the secondary paths are represented as a matrix of transfer functions, each representing the transfer behavior of the listening room from one specific loudspeaker to one specific microphone (including the characteristics of the microphone, loudspeaker, amplifier, etc.).

During operation of the ANC system, the transfer characteristics of the secondary paths may be subject to variations. A particular secondary path transfer function may vary due to many different causes: for example, when the number of listeners in the listening room changes, when a person in a listening position moves, when a window is opened, etc. Such variations result in a mismatch between the actual secondary path transfer characteristics and the transfer characteristics in the model used by the aforementioned LMS methods. Such a mismatch may result in stability problems, a reduced damping of the noise and, consequently, smaller sweet spots.

SUMMARY

A method for determining an estimation of a secondary path transfer characteristic in an ANC system is described herein. In accordance with one example of the invention, the method includes the positioning of a microphone array in a listening room symmetrically with respect to a desired listening position and reproducing at least one test signal using a loudspeaker arranged within the listening room to generate an acoustic signal. The acoustic signal is measured with the microphones of the microphone array to obtain a microphone signal from each microphone of the microphone array, and a numerical representation of the secondary path transfer characteristic is calculated for each microphone signal based on the test signal and the respective microphone signal. The method further includes averaging the calculated numerical representations of the secondary path transfer characteristic to obtain the estimation of the secondary path transfer characteristic to be used in the ANC system.

BRIEF DESCRIPTION OF THE DRAWINGS

The invention can be better understood with reference to the following description and drawings. The components in the figures are not necessarily to scale, emphasis instead being placed upon illustrating the principles of the invention. Moreover, in the figures, like reference numerals designate corresponding parts. In the drawings.

DETAILED DESCRIPTION

An exemplary active noise control (ANC) system improves music reproduction, speech intelligibility in the interior of a motor vehicle and/or the operation of an active headset with the suppression of undesired noises to increase the quality of the presented acoustic signals. The basic principle of such active noise control systems is thereby based on the superposition of an existing undesired disturbing signal (i.e., noise) with a compensation signal generated with the help of the active noise control system and superposed in phase opposition with the undesired disturbing noise signal, thus yielding destructive interference. In an ideal case, complete elimination of the undesired noise signal is thereby achieved.

Figure 1:
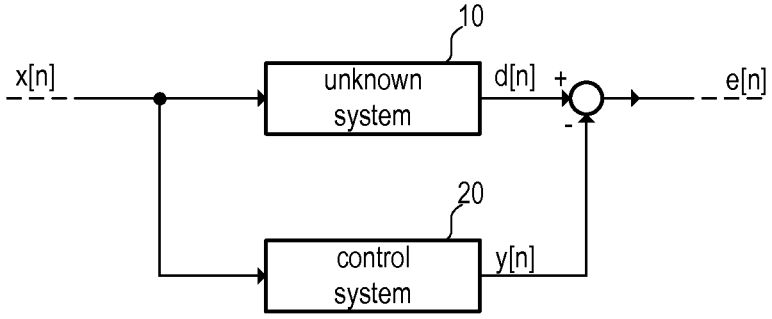
FIG. 1 is a simplified diagram of a feedforward structure.
Figure 2:
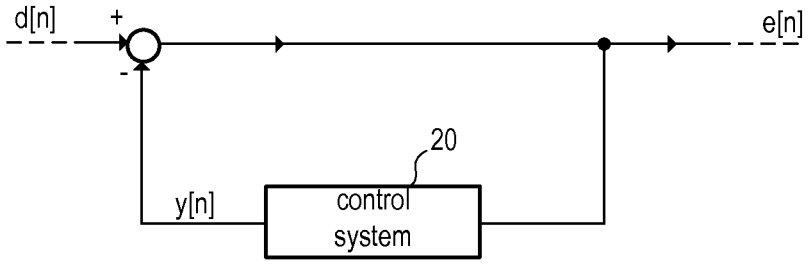
FIG. 2 is a simplified diagram of a feedback structure.

In a feedforward ANC system, a signal correlated with the undesired disturbing noise (often referred to as the "reference signal") is used to generate a compensation signal that is supplied to a compensation actuator. In acoustic ANC systems, the compensation actuator is a loudspeaker. However, a feedback ANC system is present if the compensation signal is derived not from a measured reference signal correlated to the disturbing noise, but rather only from the system response. That is, the reference signal is estimated from the system response in feedback ANC systems. In practice, the "system" is the overall transmission path from the noise source to the listening position where noise cancellation is desired. The "system response" to a noise input from the noise source is represented by at least one microphone output signal that is fed back to the compensation actuator (loudspeaker) via a control system, generating anti-noise to suppress the actual noise signal in the desired position. By means of basic block diagrams, FIG. 1 and FIG. 2 illustrate a feedforward structure and a feedback structure, respectively, for generating a compensation signal to at least partly compensate for (or ideally to eliminate) the undesired disturbing noise signal. In these figures, the reference signal that represents the noise signal at the location of the noise source is denoted by x[n]. The disturbing noise at the listening position where noise cancellation is desired is denoted by d[n]. The compensation signal destructively superposing disturbing noise d[n] at the listening position is denoted by y[n], and resulting error signal d[n]-y[n] (i.e., the residual noise) is denoted by e[n].

Feedforward systems may encompass a higher effectiveness than feedback arrangements, in particular due to the possibility of the broadband reduction of disturbing noises. This is a result of the fact that a signal representing the disturbing noise (i.e., reference signal x[n]) may be directly processed and used to actively counteract disturbing noise signal d[n]. Such a feedforward system is illustrated in FIG. 1 in an exemplary manner.

FIG. 1 illustrates the signal flow in a basic feedforward structure. Input signal x[n] (e.g., the noise signal at the noise source, or a signal derived from and correlated to the noise signal) is supplied to primary path system 10 and control system 20. Input signal x[n] is often referred to as "reference signal x[n]" for active noise control. Primary path system 10 may basically impose a delay on input signal x[n], for example, due to the propagation of the noise from the noise source to that portion of the listening room (i.e., the listening position) where suppression of the disturbing noise signal should be achieved (i.e., the desired point of silence). The delayed input signal is denoted by d[n] (desired signal) and represents the disturbing noise to be suppressed at the listening position. In control system 20, reference signal x[n] is filtered such that the filtered reference signal (denoted by y[n]), when superposed with disturbing noise signal d[n], compensates for the noise due to destructive interference in the respective portion of the listening room. As the destructive interference is not perfect, a residual noise signal remains in each of the respective portions of the listening room (i.e., in each sweet spot). The output signal of the feedforward structure of FIG. 1 may be regarded as error signal e[n], which is a residual signal comprising the signal components of disturbing noise signal d[n] that were not suppressed by the superposition with filtered reference signal y[n]. The signal power of error signal e[n] may be regarded as a quality measure for the noise cancellation achieved.

In feedback systems, the effect of a noise disturbance on the system must initially be awaited. Noise suppression (active noise control) can only be performed when a sensor determines the effect of the disturbance. An advantageous effect of feedback systems is that they can thereby be effectively operated even if a suitable signal (i.e., a reference signal) correlating with the disturbing noise is not available to control the active noise control arrangement. This is the case, for example, when applying ANC systems in environments, in which specific information about the noise source is not available (i.e., when no specific noise source is available to which a reference sensor could be assigned).

The principle of a feedback structure is illustrated in FIG. 2. According to FIG. 2, undesired acoustic noise signal d[n] is suppressed by a filtered input signal (compensation signal y[n]) provided by feedback control system 20. The residual signal (error signal e[n]) serves as an input for feedback control system 20.

In a practical use of arrangements for noise suppression, such arrangements are implemented to be adaptive, because the noise level and the spectral composition of the noise to be reduced may, for example, also be subject to chronological changes due to changing ambient conditions. For example, when ANC systems are used in motor vehicles, the changes of the ambient conditions can be caused by different driving speeds (wind noises, tire noises), different load states, different engine speeds or one or more open windows. Moreover, the transfer characteristics of the primary and secondary paths may change over time, which will be discussed later in more detail.

An unknown system may be iteratively estimated by means of an adaptive filter. The filter coefficients of the adaptive filter are thereby modified such that the transfer characteristic of the adaptive filter approximately matches the transfer characteristic of the unknown system. In ANC applications, digital filters are used as adaptive filters (for example, finite impulse response (FIR) or infinite impulse response (IIR) filters), whose filter coefficients are modified according to a given adaptation algorithm.

The adaptation of the filter coefficients is a recursive process that permanently optimizes the filter characteristic of the adaptive filter by minimizing an error signal that is essentially the difference between the outputs of the unknown system and the adaptive filter, wherein both are supplied with the same input signal. If a norm of the error signal approaches zero, the transfer characteristic of the adaptive filter approaches the transfer characteristic of the unknown system. In ANC applications, the unknown system may thus represent the path of the noise signal from the noise source to the spot where noise suppression should be achieved (primary path). The noise signal is thereby "filtered" by the transfer characteristic of the signal path, which—in the case of a motor vehicle—essentially comprises the passenger compartment (primary path transfer function). The primary path may additionally comprise the transmission path from the actual noise source (e.g., the engine or tires) to the car body or the passenger compartment, as well as the transfer characteristics of the microphones used.

Figure 3:
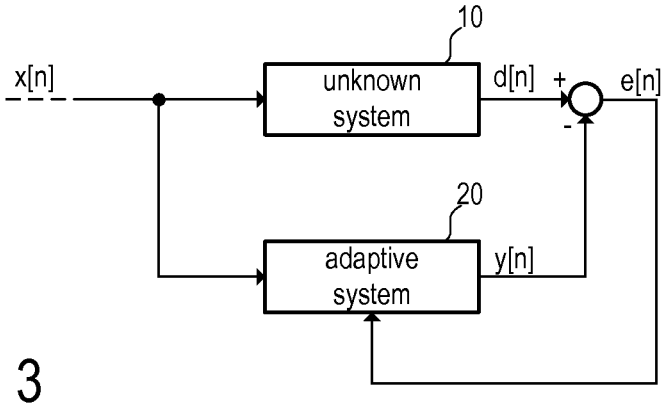
FIG. 3 is a block diagram illustrating the basic principle of an adaptive filter configured to model an unknown system.

FIG. 3 generally illustrates the estimation of unknown system 10 by means of adaptive filter 20. Input signal x[n] is supplied to unknown system 10 and adaptive filter 20. Output signal d[n] of unknown system 10 and output signal y[n] of adaptive filter 20 are destructively superposed (i.e., subtracted); the residual signal (i.e., error signal e[n]) is fed back to the adaptation algorithm implemented in adaptive filter 20. A least mean square (LMS) algorithm may, for example, be employed for calculating modified filter coefficients such that a norm (e.g., the power) of error signal e[n] becomes minimal. In this case, an optimal suppression of output signal d[n] of unknown system 10 is achieved, and the transfer characteristic of adaptive control system 20 matches the transfer characteristic of unknown system 10.

The LMS algorithm thereby represents an algorithm for the approximation of the solution to the least mean squares (LMS) problem, as it is often used when utilizing adaptive filters, which are realized, for example, in digital signal processors. The algorithm is based on the method of the steepest descent (gradient descent method) and computes the gradient in a simple manner. The algorithm thereby operates in a time-recursive manner. That is, the algorithm is run again with each new data set, and the solution is updated. Due to its relatively low complexity and low memory requirement, the LMS algorithm is often used for adaptive filters and adaptive control. Further methods may include the following: recursive least squares, QR decomposition least squares, least squares lattices, QR decomposition lattices, gradient adaptive lattices, zero forcing, stochastic gradients, etc.

In active noise control arrangements, the filtered-x LMS (FXLMS) algorithm and modifications or extensions thereof are quite often used as special embodiments of the LMS algorithm. The modified filtered-x LMS (MFXLMS) algorithm is an example of such a modification.

Figure 4:
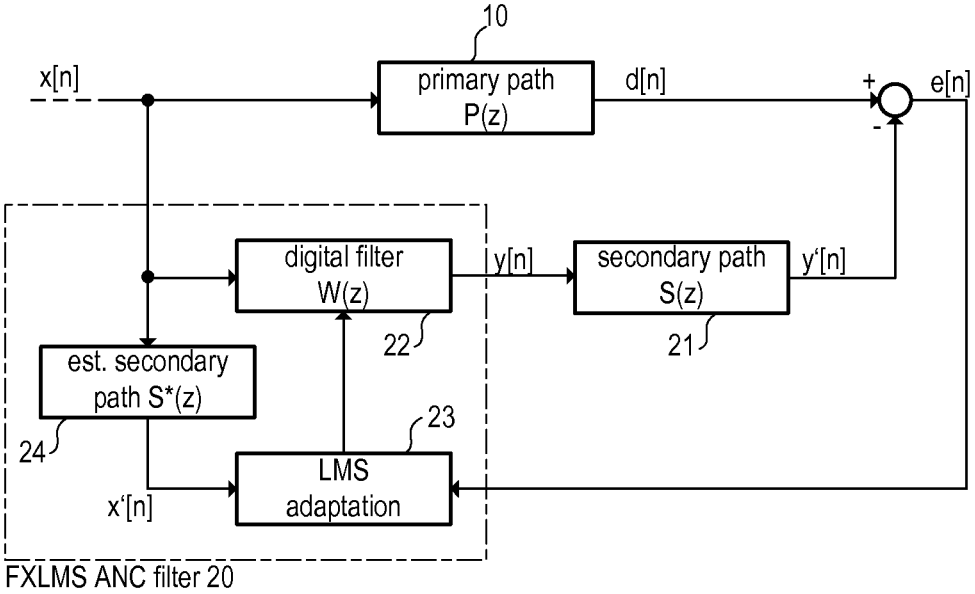
FIG. 4 is a block diagram illustrating a single-channel feedforward active noise control system using the filtered-x LMS (FXLMS) algorithm.

FIG. 4 illustrates in an exemplary manner the basic structure of an ANC system employing the FXLMS algorithm. It also illustrates the basic principle of a digital feedforward active noise control system. To simplify matters, components such as amplifiers, analog-digital converters and digital-analog converters, which are required for realization, are not illustrated herein. All signals are denoted as digital signals, with time index n placed in squared brackets. Transfer functions are denoted as discrete time transfer functions in the z domain, as ANC systems are usually implemented using digital signal processors.

The model of the ANC system of FIG. 4 comprises primary path system 10, with (discrete time) transfer function P(z) representing the transfer characteristics of the signal path between the noise source and the portion of the listening room where the noise should be suppressed. It further comprises adaptive filter 22, with filter transfer function W(z) and adaptation unit 23 for calculating an optimal set of filter coefficients $w_k=(w_0, w_0, w_2, \ldots, w_{L-1})$ for adaptive filter 22. Secondary path system 21, with transfer function S(z), is arranged downstream of adaptive filter 22; it represents the signal path from the loudspeaker radiating the compensation signal provided by adaptive filter 22 to the portion of the listening room where noise d[n] should be suppressed. The secondary path comprises the transfer characteristics of all components downstream of adaptive filter 21: for example, amplifiers, digital-analog converters, loudspeakers, acoustic transmission paths, microphones and analog-digital converters. When using the FXLMS algorithm for the calculation of the optimal filter coefficients, estimation S*(z) (system 24) of secondary path transfer function S(z) is required. That is, system 24 is a model of the secondary path transfer characteristic. Primary path system 10 and secondary path system 21 are "real" systems that essentially represent the physical properties of the listening room, wherein the other transfer functions are implemented in a digital signal processor. System 24 (i.e., the model of the secondary path), which is an estimation of the secondary path transfer function, may be measured in advance in the listening room in which the ANC system is to be used.

Input signal x[n] represents the noise signal generated by a noise source and is therefore often referred to as "reference signal". It is measured by an acoustic or non-acoustic sensor for further processing. Input signal x[n] is transported to a listening position via primary path system 10, which provides disturbing noise signal d[n] as an output at the listening position where noise cancellation is desired. When using a non-acoustic sensor, the input signal may be indirectly derived from the sensor signal. Reference signal x[n] is further supplied to adaptive filter 22, which provides filtered signal y[n]. Filtered signal y[n] is supplied to secondary path system 21, which provides modified filtered signal y'[n] (i.e., the compensation signal); modified filtered signal y'[n] destructively superposes with disturbing noise signal d[n], which is the output of primary path system 10. Therefore, the adaptive filter has to impose an additional 180° phase shift on the signal path. The result of the superposition is a measurable residual signal that is used as error signal e[n] for adaptation unit 23. To calculate updated filter coefficients $w_k$, estimated model S*(z) of secondary path transfer function S(z) is used. This may be required to compensate for the decorrelation between filtered reference signal y[n] and compensation signal y'[n] due to the signal distortion in the secondary path. Estimated secondary path transfer function S*(z) (system 24) also receives input signal x[n] and provides modified reference signal x'[n] to adaptation unit 23.

The function of the algorithm is summarized below. Due to the adaptation process, the overall transfer function W(z)·S(z) of the series connection of adaptive filter W(z) and secondary path transfer function S(z) approaches primary path transfer function P(z), wherein an additional 180° phase shift is imposed on the signal path of adaptive filter 22; disturbing noise signal d[n] (the output of primary path 10) and compensation signal y'[n] (the output of secondary path 21) thus destructively superpose, thereby suppressing disturbing noise signal d[n] in the respective portion (sweet spot) of the listening room.

Residual error signal e[n], which may be measured by means of a microphone, is supplied to adaptation unit 23 and modified input signal x'[n], which is provided by estimated secondary path transfer function S*(z). Adaptation unit 23 is configured to calculate filter coefficients $w_k$ of adaptive filter transfer function W(z) from modified reference signal x'[n] (filtered x) and error signal e[k] such that a norm (e.g., the power or $L_2$ norm) of error signal ||e[k] || becomes minimal. An LMS algorithm may be a good choice for this purpose, as already discussed above. Circuit blocks 22, 23 and 24 form active noise control unit 20, which may be fully implemented in a digital signal processor; together these circuit blocks are referred to as FXLMS ANC filter 20 in the example of FIG. 4. Alternatives or modifications of the filtered-x LMS algorithm, including the filtered-e LMS algorithm, are of course applicable.

Figure 5:
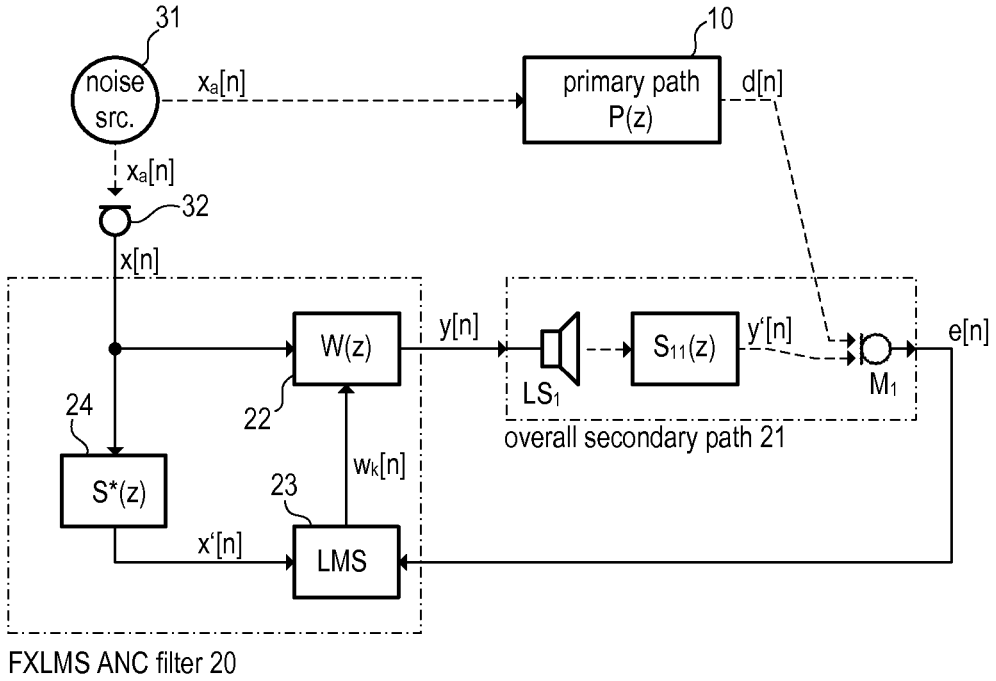
FIG. 5 is a block diagram illustrating the single-channel ANC system of FIG. 4 in more detail.

FIG. 5 illustrates a system for active noise control according to the structure of FIG. 4. To keep things simple and clear, FIG. 5 illustrates a single-channel ANC system as an example. A generalization of the multi-channel case will be shown later with reference to FIG. 6. In addition to the example of FIG. 4, which shows only the basic structure of an ANC system, the system of FIG. 5 illustrates noise source 31 generating the input noise signal (i.e., acoustic noise signal $x_a$[n] and the corresponding measured reference signal x[n]) for the ANC system, loudspeaker LS1 radiating filtered reference signal y[n] and microphone M1 sensing residual error signal e[n]. The noise signal generated by noise source 31 serves as acoustic input signal $x_a$[n] to the primary path. Output d[n] of primary path system 10 represents the noise signal d[n] to be suppressed at the listening position. A measured electrical representation x[n] (i.e., the reference signal) of acoustic input signal $x_a$[n] may be provided by acoustic sensor 32 (e.g., a microphone or vibration sensor that is sensitive in the audible frequency spectrum or at least in a desired spectral range thereof). The measured reference signal x[n] (i.e., the sensor signal) is supplied to adaptive filter 22, and filtered signal y[n] is supplied to secondary path 21. The output signal of secondary path 21 is compensation signal y'[n], which destructively interferes with noise d[n] filtered by primary path 10. The residual signal is measured with microphone M1, whose output signal is supplied to adaptation unit 23 as error signal e[n]. The adaptation unit calculates optimal filter coefficients $w_k$[n] for adaptive filter 22. The FXLMS algorithm may be used for this calculation, as discussed above. Since acoustic sensor 32 is capable of detecting the noise signal generated by noise source 31 in a broad frequency band of the audible spectrum, the arrangement of FIG. 5 may be used for broadband ANC applications.

In narrowband ANC applications, acoustic sensor 32 may be replaced by a non-acoustic sensor (e.g., a rotational speed sensor) and a signal generator to synthesize reference signal x[n]. The signal generator may use the base frequency, which is measured with the non-acoustic sensor, and higher order harmonics to synthesize reference signal x[n]. The non-acoustic sensor may be, for example, a rotational speed sensor that gives information on the rotational speed of a car engine, which may be regarded as a main noise source.

Figure 6:
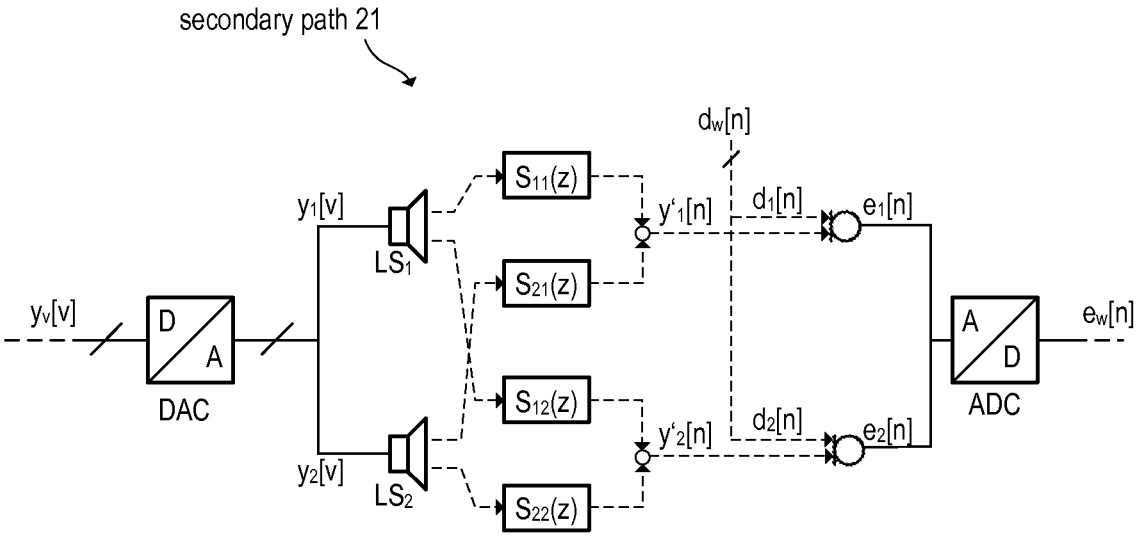
FIG. 6 is a block diagram illustrating the secondary path of a two-by-two multi-channel ANC system.

The overall secondary path transfer function S(z) comprises the following: the transfer characteristics of loudspeaker LS1, which receives filtered reference signal y[n]; the acoustic transmission path characterized by transfer function $S_{11}$(z); the transfer characteristics of microphone M1; and the transfer characteristics of necessary electrical components such as amplifiers, analog-digital converters, digital-analog converters, etc. In the case of a single-channel ANC system, only one acoustic transmission path transfer function $S_{11}$(z) is relevant, as illustrated in FIG. 5. In a general multi-channel ANC system that has a number of V loudspeakers LSv (v=1, . . . , V) and a number of W microphones Mw (w=1, . . . , W), the secondary path is characterized by a V×W transfer matrix of transfer functions $S(z)=S_{vw}(z)$. As an example, a secondary path model is illustrated in FIG. 6 for the case of V=2 loudspeakers and W=2 microphones. In multi-channel ANC systems, adaptive filter 22 comprises one filter $W_v$(z) for each channel. Adaptive filters $W_v$(z) provide V-dimensional filtered reference signal $y_v$[n] (v=1, . . . , V), each signal component being supplied to the corresponding loudspeaker LSv. Each of the W microphones receives an acoustic signal from each of the V loudspeakers, resulting in a total number of V×W acoustic transmission paths (four transmission paths in the example of FIG. 6). In the multi-channel case, compensation signal y'[n] is W-dimensional vector $y_w$'[n], each component being superposed with a corresponding disturbing noise signal component $d_w$[n] at the respective listening position where a microphone is located. Superposition $y_w$'[n]+$d_w$[n] yields W-dimensional error signal $e_w$[n], wherein compensation signal $y_w$'[n] is at least approximately in phase opposition to noise signal $d_w$[n] at the respective listening position. Furthermore, analog-digital converters and digital-analog converters are illustrated in FIG. 6.

Figure 7:
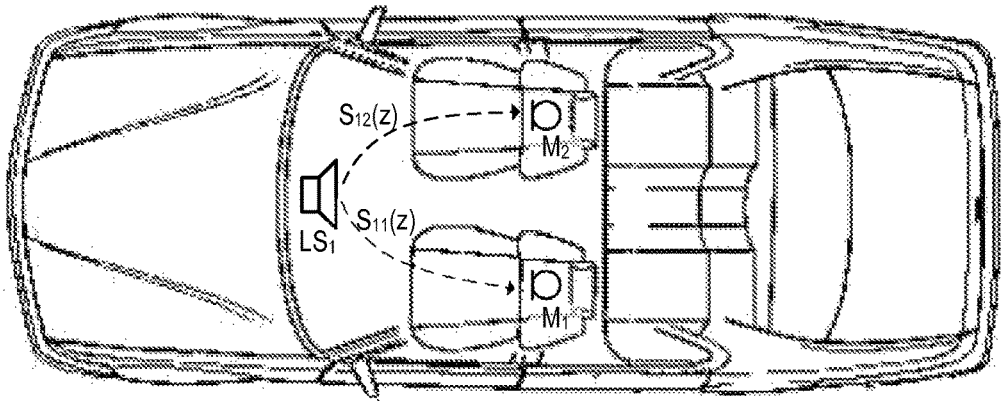
FIG. 7 schematically illustrates the installation of an ANC system in the passenger compartment of a car; in particular, the transfer functions from a first loudspeaker to two different listening positions are illustrated.

As mentioned above, estimations $S_{vw}$*(z) of secondary path transfer functions $S_{vw}$(z) are used by the LMS adaptation algorithms, which regularly calculate updated filter coefficients $w_{v,k}$ for adaptive filter transfer functions $W_v$(z). The estimations of transfer functions $S_{vw}$(z) are obtained based on measurements carried out in the listening room in which the ANC system is to be installed. Alternatively, the measurements may be carried out in a listening room that is a replica or a model of the listening room in which the ANC system is to be installed. FIG. 7 illustrates one example in which the listening room is the passenger compartment of a car and the listening positions are at the driver's and passenger's seats. The sweet spots to be generated at the listening positions should particularly enclose the areas close to the head rests where the driver's and passenger's ears are located during operation of the ANC system. To keep the illustration of FIG. 7 simple, only one loudspeaker LS1 and two microphones M1 and M2, which are associated with the two listening positions (driver's seat, passenger's seat), are shown. Loudspeaker LS1 reproduces test signals, and the resulting acoustic signals are measured by microphones M1 and M2. Transfer functions $S_{11}(z)$ and $S_{12}(z)$ can be estimated based on the test signals and the output signals of microphones M1 and M2. Different types of test signals are known for the purpose of estimation of transfer functions (also referred to as "system identification") and are therefore not discussed here in detail. For example, when using harmonic test signals, the magnitude and phase of the secondary path transfer functions may be measured (for different frequencies) by determining the amplitude and phase of the microphone signals with respect to the amplitude and phase of the test signal. Alternatively, when using broadband test signals, the magnitude and phase of the secondary path transfer functions can be measured by determining the ratios between the microphone signals and the test signals in the frequency domain.

Once measured, numerical representations of the secondary path transfer functions are stored (for example, in the memory of a digital signal processor) so they can be used by the adaptive ANC filter (see FIG. 5, FXLMS ANC filter 20). That is, the estimated secondary path transfer function(s) $S_{vw}^*(z)$ is (are) fixed and does (do) not change during operation of the ANC system. However, the conditions at which the estimations are obtained are not necessarily identical to the conditions during operation of the ANC system. As already indicated above, the actual secondary path transfer characteristics may vary as a result of various influencing parameters, although the listening room as such is always the same. Such parameters may be, for example, the number of people present in the listening room, the exact positions of the people in the listening room, the presence and sizes of other objects in the listening room, the status (open/closed) of windows, etc. These variations of the secondary path transfer functions do not completely change the frequency response of the secondary path. However, the performance of the overall ANC system may be negatively affected. That is, a mismatch between the actual secondary path transfer functions $S_{vw}(z)$ and the stored estimations $S_{vw}^*(z)$ may lead to inferior noise damping at the listening locations (i.e., within the sweet spots), as well as to a reduction in the size of the sweet spots.

Figure 8:
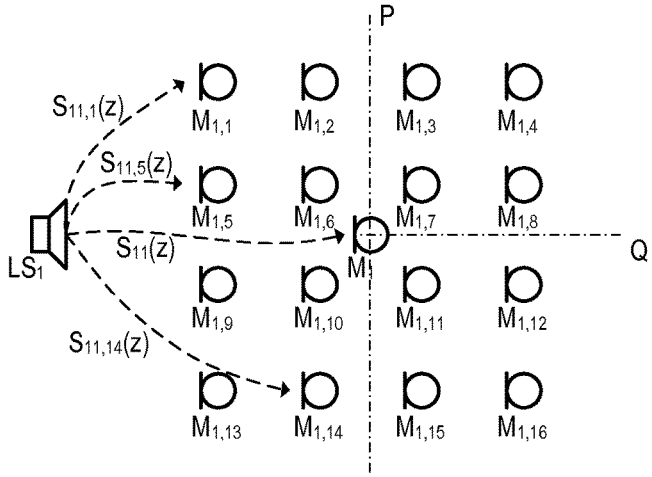
FIG. 8 illustrates a top view of a microphone array used to obtain measurement data for calculating the transfer characteristic associated with a specific listening position.
Figure 9:
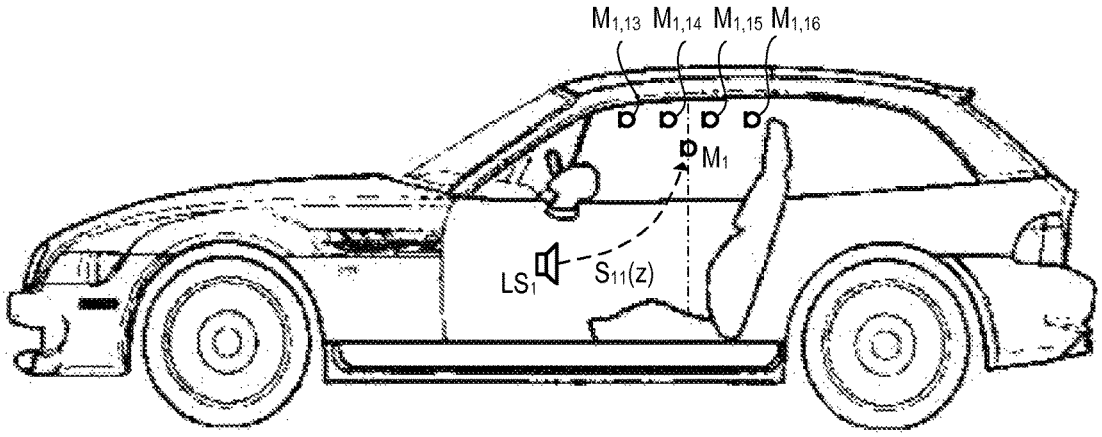
FIG. 9 illustrates a side view of the array of FIG. 8 installed in the passenger compartment of a car.

The negative effect of a mismatch between the actual secondary path transfer functions $S_{vw}(z)$ and the stored estimations $S_{vw}^*(z)$ may at least be alleviated when estimations $S_{vw}^*(z)$ are obtained by measurement not with a single microphone but rather with an array of microphones; the estimations obtained with the individual microphones of the array are then averaged to obtain the "final" estimated secondary path transfer function for a particular combination of loudspeaker $LS_v$ and the listening position. FIGS. 8 and 9 illustrate the measurement setup used for the estimation of a particular secondary path transfer function $S_{11}(z)$. In the present example, a microphone array of sixteen microphones $M_{1,1}$, $M_{1,2}$, . . . , $M_{1,16}$ is used instead of a single microphone $M_1$ (see FIG. 7). Microphone $M_1$ is, nevertheless, shown in FIGS. 8 and 9 merely to illustrate that the microphone array is arranged symmetrically with respect to the position at which microphone $M_1$ would be placed when using a single microphone for the estimation of a particular secondary path transfer function.

The present example illustrated in FIGS. 8 and 9 is directed to the estimation of secondary path transfer function $S_{11}(z)$. However, it is understood that an analog setup can be used to measure data for the estimation of other secondary path transfer functions $S_{vw}(z)$, wherein v=1, 2, . . . , V and w=1, 2, . . . , W (V being the number of loudspeakers and W being the number of listening positions). The microphone array of sixteen microphones $M_{1,1}$, $M_{1,2}$, . . . , $M_{1,16}$ is arranged close to the roof liner above the seat (e.g., the driver's seat or passenger's seat) associated with the considered listening position (e.g., front left or front right). The microphone array may be arranged symmetrically with respect to the center of the listening position (if using a single microphone $M_1$, it would be placed in the center), wherein the center of the listening position can be defined by the designer of the ANC system and is usually at the center of the head of an average person present in the listening position (in the present example, sitting in the respective seat). The symmetry planes P and Q are also illustrated in FIGS. 8 and 9.

With the measurement setup illustrated in FIGS. 8 and 9, sixteen room secondary path transfer functions $S_{11,m}^*(z)$ (m=1, 2, . . . , 16) may be calculated from measured data and the corresponding test signal(s). The final estimation $S_{11}^*(z)$, which is later used during operation of the ANC system, is obtained by averaging transfer functions $S_{11,m}^*(z)$:

$$S_{11}^*(z)=(S_{11,1}^*(z)+S_{11,2}^*(z)+\ldots+S_{11,16}^*(z))/16. \quad \text{(eq. 1)}$$

The procedure may be analogously repeated for each loudspeaker/listening position combination to obtain estimated secondary path transfer functions $S_{vw}(z)$.

Figure 10:
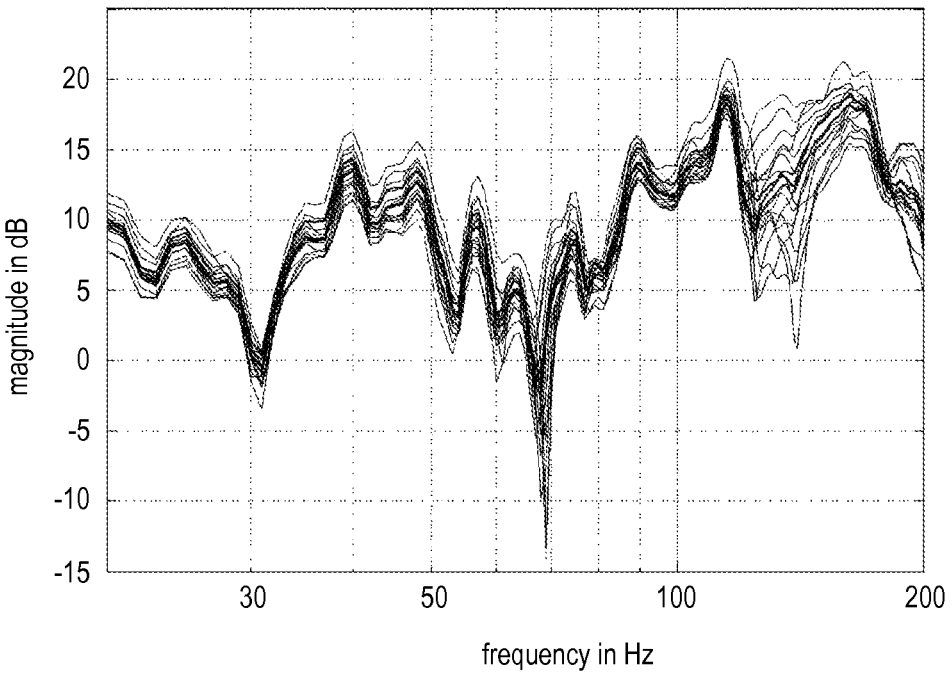
FIG. 10 is a diagram illustrating the results obtained from actual measurements with a microphone array of 16 microphones, as shown in FIG. 8.

The diagram of FIG. 10 illustrates the results obtained from actual measurements with a microphone array of sixteen microphones, as shown in FIG. 8. As a reference, a single reference microphone (see microphone $M_1$ in FIGS. 8 and 9) was placed exactly under the center of the microphone array and was used to carry out a confirmatory measurement. Magnitude responses $|S_{11,m}^*(z)|$ of estimations $S_{11,m}^*(z)$ of secondary path transfer function $S_{11}(z)$ are illustrated in FIG. 10 for frequencies ranging from 20 Hz to 200 Hz. The diagram of FIG. 10 further includes magnitude response $|S_{11}^*(z)|$ of estimation $S_{11}^*(z)$ obtained using the reference microphone (see microphone $M_1$ in FIGS. 8 and 9) instead of the microphone array. Finally, the diagram of FIG. 10 includes the average of estimations $S_{11,m}^*(z)$ (for m=1, 2, . . . , 16). To be precise, two different averaging approaches were tested. First, the complex-valued estimated transfer functions $S_{11,m}^*(z)$ (for m=1, 2, . . . , 16) were averaged before calculating the magnitude of the complex-valued average. Second, magnitude $|S_{11,m}^*(z)|$ (for m=1, 2, . . . , 16) was calculated for each estimated transfer function $S_{11,m}^*(z)$, and the calculated magnitudes were subsequently averaged. Although both approaches could be used in practice, the first approach (calculating the magnitude of the complex-valued average) yielded better results (i.e., a better match with the transfer function obtained from measurements by the reference microphone $M_1$; see FIG. 8, center microphone). It can be seen from the diagram of FIG. 6 that average $|S_{11}^*(z)|$, as defined in equation 1, and the estimation obtained with a single microphone (located at the reference position: i.e., at the head position, close to the headrest of the driver's seat), as mentioned above, match well.

Using a microphone array to measure data for determining estimations of secondary path transfer functions (by averaging) improves the robustness of the ANC system regarding two aspects. First, the estimations obtained by averaging are less susceptible to inexact positioning of the microphones used during the estimation procedure. Second, the performance of the ANC system is less susceptible to variations of the secondary path transfer functions during operation of the ANC system.

Some important aspects of the methods and systems described herein are summarized below. It is understood that the following is not an exhaustive enumeration but rather an exemplary outline. One aspect relates to a method for determining an estimation of a secondary path transfer characteristic in an ANC system. In accordance with one example of the invention, a microphone array is positioned in a listening room symmetrically with respect to a desired listening position (e.g., a seat installed in the passenger compartment of a motor vehicle; see FIG. 9). At least one test signal is reproduced using a loudspeaker (see, for example, FIG. 9, loudspeaker $LS_1$) arranged within the listening room to generate an acoustic signal. The resulting acoustic signal is measured (picked up) with the microphones (see, for example, FIG. 9, microphones $M_{1,1}, \ldots, M_{1,16}$) of the microphone array to obtain a microphone signal from each microphone of the microphone array. For each microphone signal, a numerical representation of the secondary path transfer characteristic is calculated based on the test signal and the respective microphone signal. Such a numerical representation may be a room impulse response (RIR) or a transfer function. The calculated numerical representations of the secondary path transfer characteristic are then averaged to obtain the sought estimation of the secondary path transfer characteristic to be used in the ANC system.

The microphone array may be placed such that its axis of symmetry is substantially vertical and the desired listening position is on the axis of symmetry. The microphones of the microphone array are arranged substantially in a plane (see FIGS. 8 and 9, microphones $M_{1,1}, \ldots, M_{1,16}$), and the microphone array is placed such that the plane in which the microphones of the microphone array are arranged is substantially horizontal. The microphone array may be placed vertically above the desired listening position.

In the case of a multi-channel ANC system, the procedure to determine an estimation of a secondary path transfer characteristic is repeated for each loudspeaker/listening position combination in the listening room. A set of V×W estimations is thus obtained for V loudspeakers $LS_1, \ldots, LS_V$ and W listening positions (defining the sweet spots). Generally, a multi-channel ANC system includes either at least two loudspeakers and at least one listening position or at least one loudspeaker and at least two listening positions. The secondary path estimations are used in an adaptive ANC filter (see FIG. 5, filter 20), which may make use, for example, of an FXLMS algorithm to adapt filter coefficients. In the case of a multi-channel system, the ANC filter is an adaptive filter bank.

Another aspect of the invention relates to an ANC method for reducing acoustic noise in at least one listening position of a listening room in which at least one loudspeaker is installed. In accordance with one example of the invention, at least one reference signal x[n] that is correlated with the noise is provided. In the case of a feedforward ANC system, only one reference signal is usually used. At each listening position, error signal $e_w[n]$ is measured, which represents the (residual) noise at the respective listening position. The reference signal(s) is (are) filtered with an adaptive ANC filter bank to provide, as a filter output signal, compensation signal $y_v[n]$ for each loudspeaker $LS_v$ (see FIGS. 5 and 6). The filter coefficients of the adaptive ANC filter bank are regularly adjusted based on reference signal(s) x[n], error signal(s) $e_w[n]$ and at least one estimation $S_{vw}^*(z)$ of a secondary path transfer characteristic, wherein the estimations are determined as outlined further below and discussed with reference to FIGS. 7-10.

As mentioned, the at least one reference signal x[n] that is correlated with the noise may be determined by an acoustic or non-acoustic sensor (see FIG. 5, acoustic sensor 32) in the case of a feedforward ANC system. In the case of feedback ANC systems, the reference signal(s) is (are) obtained by estimating/synthesizing based on error signal(s) $e_w[n]$ and compensation signals $y_v[n]$ (or simulated signals $y_w'[n]$).

While various embodiments of the invention have been described, it will be apparent to those of ordinary skill in the art that many more embodiments and implementations are possible within the scope of the invention. Accordingly, the invention is not to be restricted except in light of the attached claims and their equivalents. With regard to the various functions performed by the components or structures described above (assemblies, devices, circuits, systems, etc.), the terms (including a reference to a "means") used to describe such components are intended to correspond, unless otherwise indicated, to any component or structure that performs the specified function of the described component (i.e., that is functionally equivalent), even if not structurally equivalent to the disclosed structure that performs the function in the exemplary implementations of the invention illustrated herein.

What is claimed is:

1. A method for determining an estimation of a secondary path transfer characteristic in an ANC system; the method comprising:

positioning a microphone array in a listening room symmetrically with respect to a desired listening position;

reproducing at least one test signal using a loudspeaker arranged within the listening room to generate an acoustic signal;

measuring the acoustic signal with microphones of the microphone array to obtain a microphone signal from each microphone of the microphone array;

calculating, for each microphone signal, a numerical representation of the secondary path transfer characteristic based on the test signal and the respective microphone signal; and averaging the calculated numerical representations of the secondary path transfer characteristic to obtain the estimation of the secondary path transfer characteristic to be used in the ANC system.

2. The method of claim 1, wherein the desired listening position is on an axis of symmetry of the microphone array.

3. The method of claim 2, wherein the axis of symmetry of the microphone array is substantially vertical.

4. The method of claim 1, wherein the numerical representations of the secondary path transfer characteristic are room impulse responses or transfer functions or magnitudes thereof.

5. The method of claim 1, wherein the listening room is a passenger compartment of a motor vehicle.

6. The method of claim 1, wherein the desired listening position is associated with one seat installed in the listening room.

7. The method of claim 1, wherein the microphones of the microphone array are arranged substantially in a plane.

8. The method of claim 7, wherein the plane in which the microphones of the microphone array are arranged is adjusted to be substantially horizontal.

9. The method of claim 8, wherein the positioning of the microphone array in the listening room comprises placing the microphone array vertically above the desired listening position.

10. A method for determining estimations of secondary path transfer characteristics in a multi-channel ANC system that includes a listening room with either at least one loudspeaker and at least two listening positions or at least two loudspeakers and at least one listening position; for each pair of loudspeaker and listening position, the method includes determining an estimation of a secondary path transfer characteristic in accordance with the method of claim 1.

11. Use of an estimation of a secondary path transfer characteristic in an adaptive ANC filter, the estimation being determined in accordance with the method of claim 1.

12. A method for reducing acoustic noise in at least one listening position of a listening room in which at least one loudspeaker is installed; the method comprising:

providing at least one reference signal correlated with the acoustic noise;

measuring at each listening position an error signal that represents the acoustic noise at the respective listening position;

filtering the at least one reference signal with an adaptive filter bank to provide, as a filter output signal, a compensation signal for each loudspeaker; and adaptively adjusting filter coefficients of the adaptive filter bank based on the at least one reference signal, at least one of the error signals and at least one estimation of a secondary path transfer characteristic as determined in accordance with the method of claim 1.

13. The method of claim 12, wherein the at least one reference signal correlated with the acoustic noise is determined by an acoustic or non-acoustic sensor.

14. The method of claim 12, wherein the at least one reference signal correlated with the acoustic noise is synthesized based on the at least one of the error signals and at least one of the compensation signals.

15. The method of claim 12, wherein the adaptive adjusting of the filter coefficients of the adaptive filter bank is based on the at least one of the error signals and the at least one reference signal that is filtered with the at least one estimation of the secondary path transfer characteristic.

16. A method for determining an estimation of a secondary path transfer characteristic in an active noise control (ANC) system; the method comprising:

reproducing at least one test signal using a loudspeaker arranged within a listening room to generate an acoustic signal;

measuring the acoustic signal with microphones of a microphone array positioned in a listening room with respect to a desired listening position to obtain a microphone signal from each microphone of the microphone array;

calculating, for each microphone signal, a numerical representation of the secondary path transfer characteristic based on the test signal and the respective microphone signal; and averaging the calculated numerical representations of the secondary path transfer characteristic to obtain the estimation of the secondary path transfer characteristic to be used in the ANC system.

17. The method of claim 16, wherein the desired listening position is on an axis of symmetry of the microphone array.

18. The method of claim 17, wherein the axis of symmetry of the microphone array is substantially vertical.

19. The method of claim 16, wherein the numerical representations of the secondary path transfer characteristic are room impulse responses or transfer functions or magnitudes thereof.

20. The method of claim 16, wherein the listening room is a passenger compartment of a motor vehicle.

* * * * *